United States Patent [19]

Lake

[11] Patent Number: 4,609,141

[45] Date of Patent: Sep. 2, 1986

[54] FRAGILE ARTICLE CARTON WITH TOP HAVING RESILIENT ARTICLE ENGAGING FINGERS

[75] Inventor: Connie Lake, Tinley Park, Ill.

[73] Assignee: S. Eisenberg & Co., Div. of Creative Industries, Inc., Bridgeview, Ill.

[21] Appl. No.: 602,637

[22] Filed: Apr. 25, 1984

Related U.S. Application Data

[63] Continuation-in-part of Ser. No. 510,321, Jul. 1, 1983, abandoned.

[51] Int. Cl.[4] ..... B65D 1/00

[52] U.S. Cl. ..... 229/2.5 EC; 206/560; 206/523; 206/591; 206/592

[58] Field of Search ..... 229/2.5 EC; 206/560, 206/523, 591, 592

[56] References Cited

U.S. PATENT DOCUMENTS

| | | | |
|---|---|---|---|
| 2,764,334 | 6/1967 | White | 229/29 M X |
| 3,152,747 | 10/1964 | Cummings | 229/28 |
| 3,362,605 | 1/1968 | Bixlen | 229/2.5 EC |
| 3,396,895 | 8/1968 | Pearl et al. | 229/2.5 |
| 3,563,446 | 2/1971 | Lake | 229/2.5 |
| 3,664,574 | 5/1972 | Pearl et al. | 224/44 R |
| 3,672,693 | 6/1972 | Weir | 229/44 R |
| 3,920,178 | 11/1975 | Mollen | 229/2.5 EC |
| 3,980,221 | 9/1976 | Okada | 229/14 C |
| 4,059,219 | 11/1977 | Reifers et al. | 229/2.5 EC |
| 4,193,531 | 3/1980 | Saby | 206/583 |
| 4,295,597 | 10/1981 | Petersen | 229/44 EC |
| 4,462,537 | 7/1984 | Grootherder et al. | 229/2.5 EC |
| 4,480,781 | 11/1984 | Emery et al. | 229/2.5 EC |

FOREIGN PATENT DOCUMENTS

| | | | |
|---|---|---|---|
| 182075 | 5/1955 | Fed. Rep. of Germany | 206/583 |
| 945136 | 6/1956 | Fed. Rep. of Germany | 206/583 |
| 2927665 | 1/1981 | Fed. Rep. of Germany | 229/2.5 EC |
| 2424858 | 5/1978 | France | 229/2.5 EC |
| 319421 | 9/1966 | Sweden | 206/583 |
| 797479 | 7/1958 | United Kingdom | 229/2.5 EC |
| 932669 | 10/1961 | United Kingdom | 206/583 |

*Primary Examiner*—Joseph Man-Fu Moy

*Attorney, Agent, or Firm*—Hill, Van Santen, Steadman & Simpson

[57] ABSTRACT

Molded plastic carton universally adapted for various sizes of articles such as eggs and including a tray section having rows or article-carrying cells. A cover section may be hinged to the tray section and has an undersurface provided with spring retainer fingers for resiliently biasing articles into their cells. The arrangement is such as to accommodate a range of different sizes of articles in the cells.

23 Claims, 12 Drawing Figures

FRAGILE ARTICLE CARTON WITH TOP HAVING RESILIENT ARTICLE ENGAGING FINGERS

PRIOR APPLICATION

This application is a continuation-in-part of my copending application, Ser. No. 510,321, filed July 1, 1983, now abandoned.

BACKGROUND OF THE INVENTION

The packaging of eggs or other fragile articles for sale to the public has heretofore been a problem due not only to the fragile nature of the articles, but also, especially as related to eggs, to the fact that the eggs are sold in dozen lots of small, medium, large, and extra large sizes, and from an economical standpoint it is desirable to have one cartion size which will effectively carry at least multiple lots of eggs or at least two or more of the recognized sizes, i.e., small, medium, large or extra large, without the liability of cracking the eggs during shipment and handling, or at the place of sale.

Egg cartons usually have a tray section and a cooperating lid or cover section and defining generally ovate cells of a mean size, which will carry all commercial sizes of eggs in dozen lots of each size. With such cartons, the general practice has been to shape the cells to receive the expected largest eggs having the "worst case" shape variation. Inasmuch as eggs are a product of nature, they vary not only in size but also in shape, such that eggs, if given standard size designation, will not all have the same shape. As a result, when a standard carton (non-jumbo) is used, at least some, if not all, of the eggs will fit too loosely, with the result that some of the eggs are subject to cracking during shipment and handling, and when the purchaser is carrying the carton of eggs to a place of use.

SUMMARY, ADVANTAGES AND OBJECTS OF THE INVENTION

The fragile article carton of the present invention has a tray section and a cover or lid section. A plurality of rows of article receiving cells in the tray section comprise cavities of a semi-ovate form with separator walls molded in the molding of the carton and arranged to extend at least part way across the carton for separating the cells of the cell rows and generally contributing to the semi-ovate form of the cells which open upwardly in the tray section. These separator walls may extend close to the top of the tray section. The cover or lid section is hinged to the top of one of the sidewalls of the tray section and forms a functionally integral part of the carton. A locking flap may be hinged to the opposite sidewall of the tray and has spaced locking means separably cooperative with complementary locking means on the lid section. In some carton constructions separate covers and trays may be used which are not hinged together, and I wish to include such construction as being within the purview of my invention.

The cover section has depending abutment separators extending thereacross, and abuttingly engaging the separator walls of the tray section when the carton is locked closed. Each abutment separator may be recessed inwardly from the top of the lid, and may be of a modified V-shape form extending transversely of the carton.

New and improved means are provided comprising resilient, springy, fingers carried by the cover or lid section of the carton for resiliently biasing the fragile articles into firm retained relation within the cells in the closed condition of the carton. The construction and relationship of the fingers is such that at least a major range of commercial sizes of the articles can be effectively accommodated in one size of carton.

Thus, an important advantage of the present invention is that by means of the resiliently biased finger structure, a single dozen sized egg carton may be adapted to accommodate either a dozen of extra large size eggs, a dozen of large size eggs, a dozen of medium size eggs or a dozen of small size eggs, and the eggs will be effectively retained to their cells regardless of size differentials, whether of a more or less uniform grade or of a yard run grade where the eggs in any dozen lot may be of different sizes.

A further advantage of the invention is that the resilient fingers are adapted to be provided inexpensively and efficiently as parts of the carton cover section manufactured in customary manner.

A still further advantage of the invention is that by the simplicity and effectiveness of the resilient retaining fingers extending from the cover section of the carton, the carton may safely be used for the articles, such as for eggs, of different sizes of dozen or other selected lots, and the resiliency of the retaining fingers engaging the eggs protects the articles from damage, and resiliently holds the articles to the bottoms of their cells regardless of variations in their size.

An object of the invention, therefore, is to provide a new and improved egg carton universally adapted to carry various commercial sizes of eggs, and to retain the eggs to the egg cells of the carton, with a minimum liability of cracking during handling.

Another object of the invention is to provide an egg type carton suitable for molding from a foam or other plastic material, and so arranged as to resiliently retain the eggs or the articles to their cells in the carton by fingers depending from the cover section of the carton and as an incident to closing the lid onto the tray of the carton.

A further object of the invention is to provide a molded egg type carton, in which the lid is hinged to one side edge of the carton tray and locked to the other side of the tray when the lid is closed, and which has a plurality of r4silient, spring retainer fingers extending from opposite sides of the center line of the lid, to resiliently engage the sides of the articles in each of side-by-side rows of cells when the lid is closed, and to thereby adapt the carton to variosu sizes of articles, and lessen the danger of damaging the articles during shipment and carrying from the store to an extent not possible from previous egg type cartons.

These and other advantages and objects of the invention will appear as the following specification proceeds and with reference to the accompanying drawings wherein:

DESCRIPTION OF DRAWINGS

FIG. 9 is a vertical sectional detail view taken substantially along the line IX—IX of FIG. 8.

FIG. 10 is a fragmentary top plan view taken substantially along the line X—X in FIG. 9.

FIG. 11 is a vertical sectional detail view taken substantially along the line XI—XI in FIG. 10; and FIG. 12 is a fragmentary enlarged detail view taken substantially along the line XII—XII in FIG. 10.

DETAILED DESCRIPTION OF THE INVENTION

Figure 1:
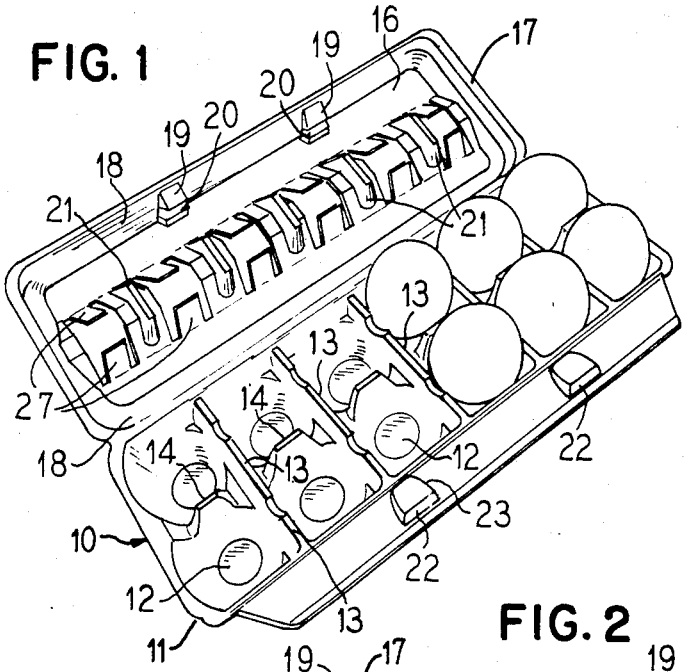
FIG. 1 is a perspective view of an open egg carton partially filled with eggs, with the lid extending from one side of the carton and a locking flap hingedly molded to extend from the opposite side of the carton.

In the embodiment of the invention illustrated in FIGS. 1-6, I have shown an egg carton 10 which may be suitably molded from plastic foam materials such as polystyrene or other suitable forms of plastic materials, and which may also be molded from pulp, although plastic material such as polystyrene may be preferable, due to the resilience of the plastic material in comparison with the resilience of molded pulp.

The carton 10 includes a bottom half or base providing a tray section 11 having a plurality of rows of semi-ovate egg cells 12 formed therein, and herein shown as being six rows of side-by-side cells, separated by transversely extending parallel barriers or divider walls 13 conforming to the general form of the ovate egg cells. The cells 12 may be completed by longitudinally extending barriers or dividers 14. The walls 13 are abutted by converging abutment separators 21 depending from the inside of a top 16 of a lid section 17 for the carton. It will be understood that many variations of the shape and placement of the walls 13 and dividers 14 are possible such as upright posts at the nominal intersection of 13 and 14, the posts and carton sides interconnected by shorter ribs, or full height continuous grid walls, or even spaced and shaped pillars. As used herein, the terms "wall dividers" and "separators", when referring to 12, 13 and/or 14 are intended to refer to all such variations unless the usage is expressly limited.

The lid section 17 is desirably integrally hinged to the carton along one side of the tray section 11 during the molding process, in a conventional manner. The lid section 17 conforms generally to the dimensions of the top portion of the tray section 11 and has opposite sidewalls 18, one of which is hinged at its lower end to the tray section, and the other of which has interlock means in the form of keeper portions 19 formed to project inwardly on the associated wall 18. Interlock recess means 20 in the keepers 19 engage keeper lips 22 at inwardly recessed portions 23 on a locking flap hinged to the opposite side of the tray 11 from the lid 17.

The abutment separators 21, which may also be called bolsters, extend inwardly from the top portion 16 of the lid 17 and may be generally hollow and open to the top of the lid, and form abutments for the lid, abuttingly engaging the transverse divider walls 13, which separate the cell areas 12 into six rows of two cells for a carton containing a dozen eggs. It is, of course, understood that the cells need not be in rows of two, but may be in rows of three for cartons containing eighteen eggs, but usually are in rows of two.

By preference, the abutment separators 21 are generally V-shaped in form (FIG. 3) and extend downwardly from longitudinally extending ribs 25. The ribs 25 merge into relatively flat apices 26 extending on axes normal to the separators 21, and form reinforcements for the upper end portions of the separators 21 and cooperate with the hollow separators 21 to reinforce the top of the carton.

Between the ends of the ribs 25, and integrally resiliently connected to the top of the carton in the molding thereof, and extending inwardly in line with the base ends of the walls of the ribs 25, as shown in FIGS. 1, 2, 3, 5 and 6, are resilient retainer fingers 27, biased to extend generally convergently inwardly toward one another and adapted for resiliently engaging the articles in the cells 12. The fingers 27 function to bias and retain the articles toward the bottom of the cells 12.

Figure 5:
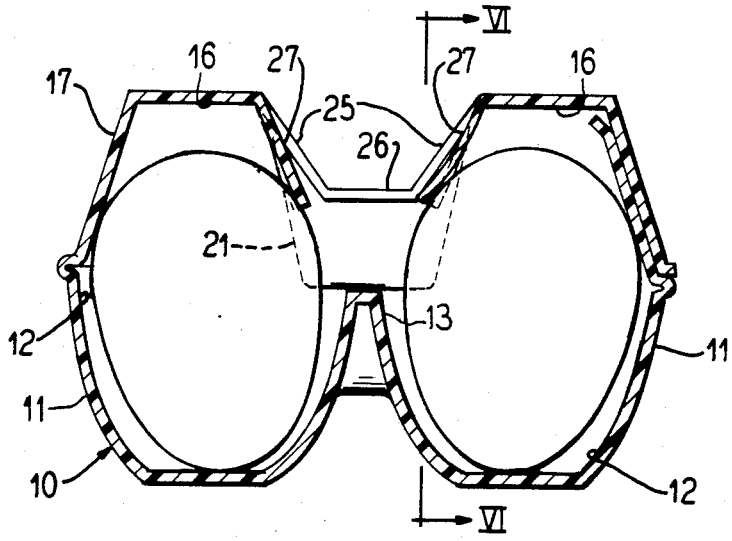
FIG. 5 is a transverse sectional view of the carton showing eggs in two adjacent cells of the carton and showing the retaining fingers resiliently retaining the eggs to the carton cells.

It should be understood from FIG. 5 that the narrower the apices 26 of the ribs 25, the farther along the sides of the separator strips 21 the ribs 25 will extend, enabling the retainer fingers 27 to terminate farther inwardly of the lid 17, when in its closed position. As shown, the spring retainer fingers 27 are located by pairs aligned with and biased to extend into such relation over the associated pair of egg cells 12 as to efficiently engage the top portions of articles such as eggs in the cells 12 and apply generally downward and lateral spring force firmly pressing the articles against cushioning surfaces of the carton within the cells.

Figure 6:
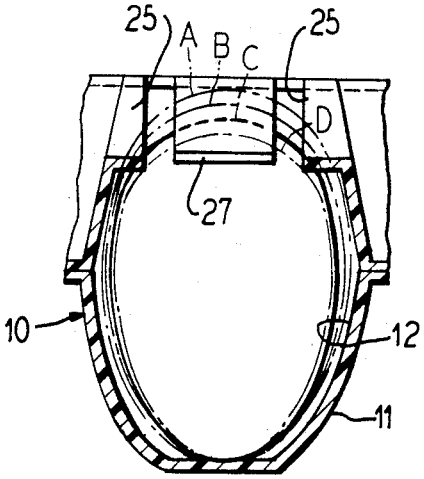
FIG. 6 is a sectional view taken substantially along line VI—VI of FIG. 5 and illustrating how the same carton may carry small, medium, large or extra large commercial sizes of eggs.
Figure 2:
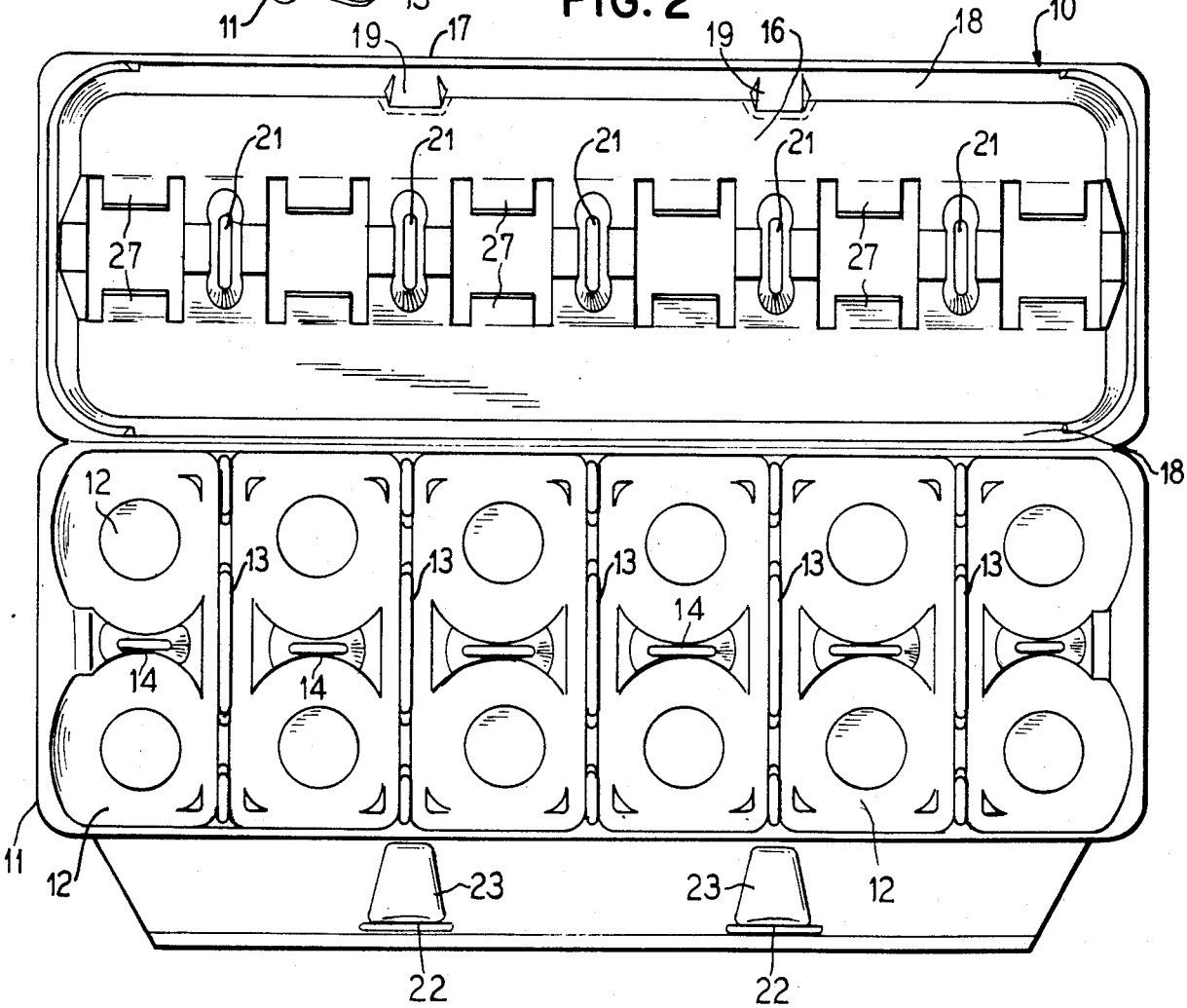
FIG. 2 is a top plan view of the carton shown in FIG. 1 with the lid and locking flap in open positions.
Figure 3:
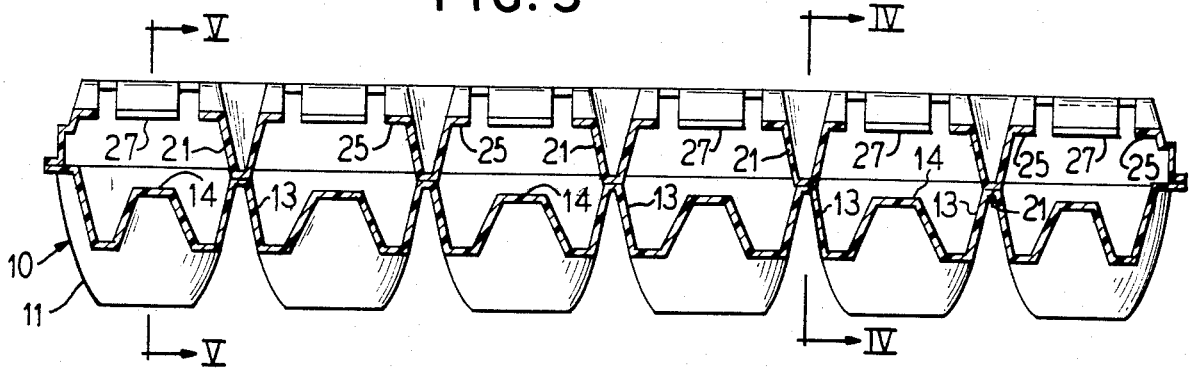
FIG. 3 is a longitudinal sectional view taken through a carton constructed in accordance with the principles of the present invention, with the lid in a closed position.
Figure 4:
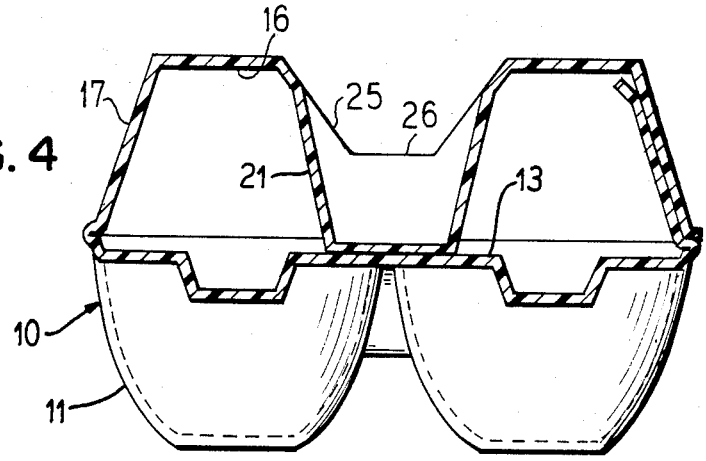
FIG. 4 is a transverse sectional view taken substantially along line IV—IV of FIG. 3.

FIG. 6 is a fragmentary sectional view showing a single cell 12 sized to contain eggs of an extra large size, as indicated by reference numeral A, or large size eggs as indicated by reference numeral B, medium size as indicated by reference numeral C, or the small size as indicated by reference numeral D. Each size of eggs in the carton is compressively engaged by the resilient fingers 27, and retained in its egg cell relatively free from rocking back and forth in the cell, and thereby enabling a single size cell to contain eggs of different sizes without the danger of cracking the eggs so the same carton may be used for shipping and displaying eggs in dozen quantities of small, medium, or large or extra large sizes. It will be appreciated that design considerations may indicate a preference that some cartons be more limited in the range of sizes which may be accommodated. For example, when it is desired to have relatively wide flat side border portions of the top 16, the carton may be designed to have only extra large and large eggs engaged by the fingers 27.

Figure 7:
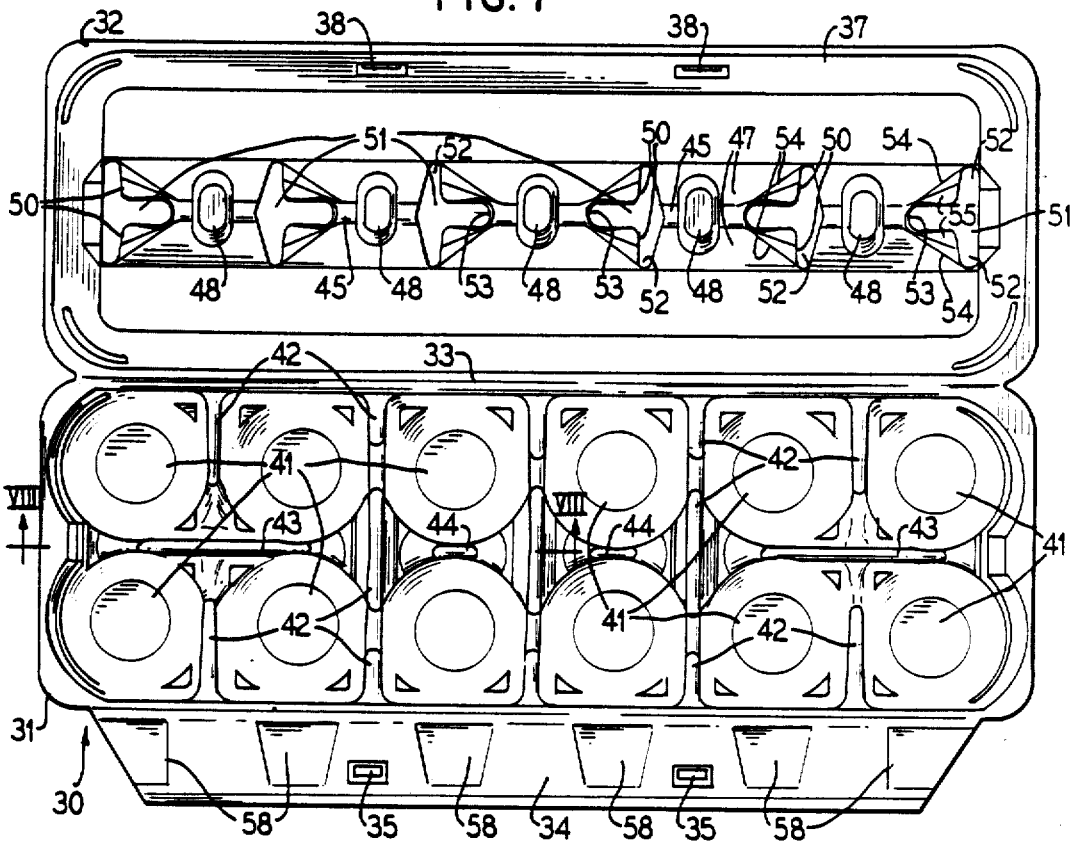
FIG. 7 is a top plan view of a fragile article carton showing the same laid open.

In another best mode form of the invention, and in some respects preferred, a carton 30 (FIG. 7), shown as of a dozen article capacity, is adapted to be manufactured employing the same manufacturing techniques as the carton 10, and desirably comprising the shear molding technique which is commonly employed for producing this type of carton. Similarly, as in respect to carton 10, the carton 30 has a bottom section or tray 31 and a top closure section or lid 32 which is connected along a longitudinal rear edge of the lid 32 to a longitudinal edge of the tray 31 as by means of an integral hinge 33. For latching the carton closed by swinging the lid 32 onto the tray 31, the tray is desirably provided along its front edge with an integrally hingedly connected retainer flap 34 provided at suitable symmetrically disposed longitudinally spaced positions with press formed latching lugs 35 adapted when the flap 34 is swung upwardly to be received within a front wall 37 of the lid for snap-in reception of the latching lugs 35 in complementary matching latching recesses in the form of apertures 38 in the wall 37. In the latched interengagement, downwardly facing latching shoulders 39 on the lugs 35 engage latchingly with complementary latching shoulders 40 along the lower edges of the latch apertures 38. The shoulders 39 are desirably formed with a downwardly and inwardly slanting cam surface formation to exert a frictional downward drawing force on the lid 32 whereby to hold the lid snugly against the tray 31.

Within the body of the tray 31, it is divided into a generally symmetrical array of article receiving cells 41. For efficiently accommodating the ends of eggs, the cells 41 are of generally complementary semi-ovate shape. Transversely extending parallel barrier or divider walls 42 divide each adjacent pair of the cells 41 from the other pair. Longitudinally extending aligned barriers or dividers 43 of which there are two relatively long ones respectively separating the four endmost cells 41, and short dividers 44 aligned with the dividers 43 and separating the center four cells 41.

Figure 8:
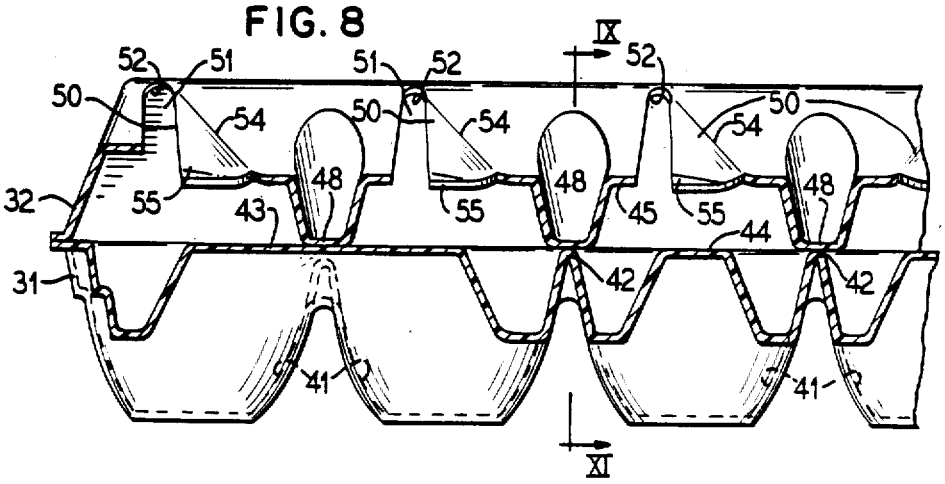
FIG. 8 is a fragmentary, enlarged vertical sectional detail view taken substantially along the line VIII—VIII of FIG. 7 and showing the carton closed.

In complement to the cell structure of the tray 31, the lid 32 has longitudinally extending central indented rib 45 of generally V-shaped cross section and having converging sidewalls 47 extending about half the depth into the lid 32. At longitudinally spaced intervals matching the spacing of the transverse dividers 42, the rib 45 has depressed therein respective bolster 48 which are of a length to engage the longitudinal divider walls 43 adjacent to the opposite ends of the tray 31 and to engage the transverse divider walls 42 in the central portion of the tray 31. (FIGS. 8 and 9)

New and improved means for resiliently biasing the fragile articles such as eggs 49 (FIGS. 10–12) into firm retained relation within the cells 41 comprise resilient, spring fingers 50 carried by the lid 32 in such a manner that when the lid is closed down onto the tray 31, the fingers will engage the upper portions of the articles and press the articles with firm spring pressure into the cells 41. In an especially efficient, easily shear molded form, the biasing fingers 50 are provided by cooperative paris on the sides 47 of the longitudinal rib 45 and so located that one of the fingers 50 is aligned in article biasing relation with respect to each of the cells 41. In forming the fingers 50, the divider rib 45 is formed with a series of generally T-shaped apertures 51, with one of the apertures 51 for each transverse pair of the cells 41 and generally aligned between the associated pair of cells in each instance so that respective opposite portions 52 of the head of the T will generally overlie one of the associated pairs of transversely aligned cells 41. A leg portion 53 of each of the apertures 51 extends longitudinally along the rib 45. In a preferred arrangement, the fingers 50 are formed from and are integral with the sides 47 of the rib 45 and are integrally joined therewith along releatively stiff bend lines 54 extending generally from the distal end of the adjacent aperture leg 53 to the distal or outer end of the head arm portion 52 of the associated aperture 51. This provides a generally triangularly shaped finger in each instance having its longest dimension at its hypothenuse which is at the juncture 54. On its free end portion the finger 50 in each instance is formed with an article engaged cam pad 55.

As best seen in FIGS. 10–12, when the cover 32 is closed onto the tray 31, the upper portion of an article 49 such as an egg is adapted to be engaged by the finger 50 associated with the cell 41 in which the article is supported and a resilient pressure is applied to the article as indicated by the force vector arrow 57 in FIG. 11, which firmly presses the article downwardly and laterally toward and into engagement with surfaces within the associated cell 41, as well as associated surface in the area of the lid 32 opposite the resilient biasing finger 57. Since the flap 34 presents a double thickness at the front of the carton in contrast to the single thickness of the back of the tray 32, clearance relief recesses 58 are desirably provided in the inner face of the flap 34 to accommodate the upper portion of the article 49 generally opposite the bias thrust 57 of the asociated finger 50. An advantage of the recesses 58 where they are shear press molded in self-sustaining sponge material from which cartons of this kind are customarily made, the pressed in areas 58 provide stiffening reinforcement for the flap 34.

It may be observed that by virtue of the generally triangular shape of the fingers 50, and a slightly pressed in deflection of the fingers 50 relative to the sides 47 of the rib 45, a substantial range of sizes of articles 49 is adapted to be efficiently accommodated in the tray 30. For example, referring to FIG. 12, three different sizes of the article 49 are represented and the unsprung position of the spring finger 50 is adapted to accommodate all sizes from relatively small size (dot-dash outline), medium size (full outline) and large size (dashed outline). It will be appreciated, of course, that as the finger 50 in any instance is sprung farther outwardly, it also substantially proportionately stiffens so that the larger, and presumably heavier articles are progressively efficiently accommodated.

It will be understood that the spring fingers 27, 50, being resiliently biased generally downwardly from the top into contact with the article, have the effect of seating the article properly in the cells 12, 41 while urging the articles toward the opposed bottom corner of the cell 12, 41 of the tray 11, 30.

The principles of the present invention may be applied to cartons containing various articles, including eggs and especially delicate articles such as Christmas tree ornaments and the like, to retain the ornaments or other fragile articles to their cells in the carton during shipment and handling, with a minimum liability of damage to the fragile articles.

While I have herein directed the invention to a carton that may be molded from foam polystyrene and adapted for articles such as eggs, it should be understood that the same principles may be applied to cartons molded from polyethylene or molded from pulp and that the principles of the invention are effective for various types of cartons adapted to contain various selected articles of different sizes.

I claim as my invention:

1. For use as a carton for eggs or like fragile articles, a tray having a plurality of article carrying cells therein, the end cells being defined by the insides of end walls of the tray and opposite side walls thereof, and spaced separator walls extending across the tray parallel to each other, for the length of the tray and converging toward their upper ends and continuing the cells for the length of the tray, a cover hinged to the tray section along one side thereof, a locking flap extending along the opposite side of the tray from the side of the hinge for the cover section, said cover section having parallel spaced traversely extending abutment separators depending from and spaced along the top thereof and the separators having walls converging toward abutment surfaces thereof, said cover section having a plurality of inwardly extending compression finger means located between said abutment separators biased to extend inwardly of said cover section to form spring article engaging means conforming resiliently to the form of articles in said cells and resiliently retaining fragile articles in said cells against damaging movement thereof in said cells during shipping and handling, and being of sufficient resiliency to retain articles of different configurations and sizes in said cells with a minimum liability towards breakage of the articles during shipping, displaying and handling of the packed cartons by the customer, said finger means biasing said articles towards sid walls of said cells, said article engaging means biasing said articles downwardly and laterally towards and into engagement with side walls of said cell.

2. The egg carton of claim 1 wherein the abutment separators are closed at their insides and open to the outside of the cover section and extend thereacross, to give rigidity thereto and have abutting engagment with said dividers extending across the tray section, to separate the cells in said tray above the centers thereof and to reinforce said cover section.

3. The carton of claim 2 wherein each abutment separator has opposite wall portions converging from the top of the cover on all sides thereof, as they extend downwardly thereof, and has ribs extending inwardly of opposite sides thereof and converging as they extend inwardly of said cover section, and said compression fingers are spaced between said ribs and are free to move relative thereto, to resiliently hold the articles in position, and to accommodate articles of different sizes to be placed in the carton and held therein.

4. The carton for eggs and like fragile articles of claim 3 wherein the cover section is integrally molded to extend along the tray and to be hinged thereto and a locking flap is hinged to the sidewall of the tray opposite the hinged portion of the cover section and has a pair of locking means, cooperating with said cover section to lock the cover section in a closed position by engagement with locking means of said cover section.

5. The carton of claim 4 wherein the abutment separators open at their tops and form transverse reinforcements for said cover section to retain said cover section in a sufficiently rigid condition to accommodate said locking means to effectively lock the cover section closed.

6. A carton for eggs or like fragile articles comprising a tray section having a plurality of article carrying cells therein and adapted to contain eggs of differing size, the margins of said cells being defined by dividers extending thereacross dividing the cells in rows of two, and by side walls of said tray section, a cover section integrally hinged to said tray section along one side thereof, a locking flap extending along the opposite side of said tray section from the hinged portion of said cover section and having spaced locking means cooperating with said cover section to lock the carton closed, said tray section having transversely extending separator walls extending thereacross and defining opposite side walls of at least some of side cells and formed to complete the cells, and said cover section having a top and inwardly extending abutment separators spaced apart a distance substantially equal to the spacing across a cell and abuttingly engaging said transverse separator walls when the cover section is closed, and resilient retainer fingers between said abutment separators and extending angularly inwardly from the carton lid in converging axes, to resiliently engage articles in said cells and retain the articles from motion within the cells and reduce the likelihood of damage to the articles therein, said fingers each having a first end formed integrally with said top and a free end spaced from the first end, the free ends each having an adjacent article contacting surface and the fingers being resilient whereby the article contacting surfaces can move relative to the first ends as required by contact with the articles, the surfaces effective to bias the articles downwardly and sideways in the cells into biased contact with side and bottom walls of said cells.

7. The carton of claim 6 including ribs extending inwardly of opposite sides of said abutment separators and along sides of said resilient retainer fingers to provide spacers for said fingers and allow relatively free, flexible movement thereof to conform to the sizes of articles in said cells.

8. A carton having a base and a lid, the base having a recessed interior divided into a plurality of individual article receiving cells, the lid having an undersurface providing a covering top for said cells when said lid is positioned over said base, said lid having a plurality of resilient depending fingers, at least one of said fingers for each of said cells, said fingers depending in a direction nonperpendicular to a plane of the top of the lid and being arranged to engage an outer surface of an article received in a cell associated with each of said fingers to resiliently bias said article downwardly and laterally towards a corner of said cell formed at a bottom of the cell.

9. A carton according to claim 8 wherein said carton base has two parallel rows of cells, said lid having two parallel rows of depending fingers, said fingers extending from a portion of the undersurface intermediate a side edge and the middle of said lid longitudinally thereof, said fingers depending downwardly and inwardly towards the middle.

10. A carton according to claim 9 wherein said fingers are formed integrally with the carton, said carton being formed of a molded foamed plastic.

11. A carton according to claim 10 wherein said top is formed with a plurality of openings therethrough extending along the length of said carton adjacent the longitudinal middle thereof, said fingers extending from side walls of said openings.

12. A carton according to claim 11 wherein said cells in said base are separated along the length of said base by upstanding wall portions projecting upwardly from a bottom of said base towards an open top thereof, said lid having a plurality of depending barrier means formed on the undersurface thereof, said barrier means extending a distance from said lid sufficient to contact said upstanding wall portions when said lid is closed upon said base.

13. A carton according to claim 12 wherein two of said fingers project from the undersurface of said lid between each of said barriers.

14. The carton of claim 12 wherein the base and lid are hinged together along one side and have mutually engaging fastening means in a side opposite the hinge.

15. A carton comprising hinged together base and lid with a hinge connection extending along the length of said carton, a latch means extending along a length of said carton on a side of said base opposite said hinge connection, a plurality of individual article containing cells formed in said base open to a thereof, said lid having an undersurface adapted to be closed over said base defining a plurality of semi-enclosed article receiving areas comprising said cells, means depending from said underside and projecting into each of said areas, said means being resilient and being arranged to engage an article received in each of said cells, said means effective to bias said article downwardly and laterally against a side and bottom wall of said cell.

16. A carton which is adapted for carrying relatively fragile articles, such as eggs, and having a tray provided with a plurality of upwardly opening article-receiving cells, and a lid complementary to and engageable in closing relation on said tray, and comprising: finger means depending from an undersurface of said lid having free ends projecting toward said cells, said finger means free ends being resiliently yieldable with respect to portions of said lid and said free ends being arranged to engage articles such as eggs received in said cells and effective to urge said articles resiliently downwardly and laterally toward seated position in said cells against side and bottom walls of the cells.

17. A carton according to claim 16, wherein said finder means comprise fingers of generally triangular shape having elongaged hypothenuse integrally attached to said lid.

18. A carton according to claim 17, wherein said fingers have camming tips engageable with the articles.

19. A carton according to claim 16, wherein said lid has a longitudinally extending inwardly projecting rib, said rib having generally T-shaped slots each including a leg extending longitudinally along the rib and arms extending from one end of the leg, said fingers being of generally triangular shape and having hypothenuse extending from the free end of said leg to the free end of an adjacent arm.

20. A carton according to claim 16, wherein said tray has along one edge a hingedly attached flap, said lid has a surface receptive of said flap in the closied relation of the lid to the tray, and said flap has clearance recesses at intervals matching the location of adjacent cells, said fingers being adapted to press the articles toward the flap and said recesses providing clearance receptive of the articles as pressed by the fingers.

21. A carton which is adapted for carrying relatively fragile articles, such as eggs, having a tray portion and a lid portion, each having side walls and end walls and having opposed recesses defined between said side walls and end walls, the lid having a top and a tray having a bottom, the lid being hinged to the tray along one side of the carton whereby the lid may be pivoted about said hinge to close said tray with said opposed recesses defining an interior for receipt of said fragile articles, internal divider means in said tray projecting from said bottom thereof and defining cell walls forming a plurality of upwardly opening article receiving cells, and resilient biasing means depending from said top of said lid portion, said biasing means having article engaging surfaces positioned with respect to said cells to engage a surface portion of a portion of an article received in each of said cells which extends from the recess of the tray into the area of the recess of the lid, said resilient biasing means effective to urge each of said articles resiliently towards a bottom of said cells and sideways towards a cell wall of each of said cells, whereby the articles are seated in said cells and restrained against movement therein.

22. The carton of claim 21 wherein each cell is defined by portions of said divider means and portions of inside surfaces of at least one of the side walls and end walls of the tray.

23. The carton of claim 22 wherein the biasing means comprises individual finger means having a free end projecting into the recess and an opposite end integral with the lid top.

* * * * *

UNITED STATES PATENT AND TRADEMARK OFFICE

CERTIFICATE OF CORRECTION

PATENT NO. : 4,609,141

DATED : September 2, 1986

INVENTOR(S) : Connie Lake

It is certified that error appears in the above-identified patent and that said Letters Patent is hereby corrected as shown below:

The sheets of drawing consisting of figures 7-12 should be added as per attached sheets.

Signed and Sealed this

Seventeenth Day of March, 1987

*Attest:*

DONALD J. QUIGG

*Attesting Officer*

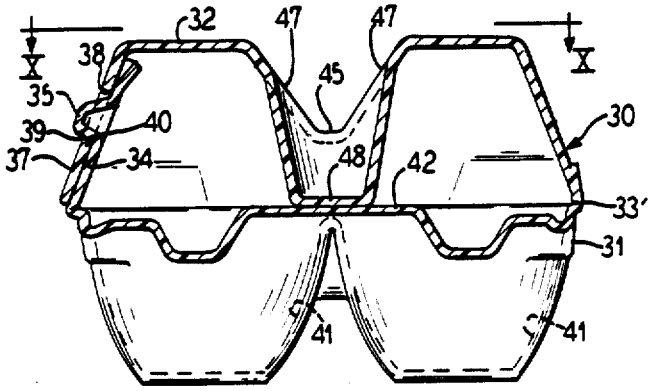
FIG. 9
FIG. 11
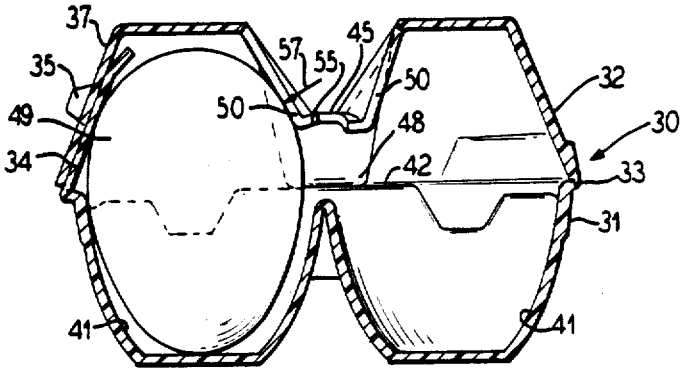
FIG. 10
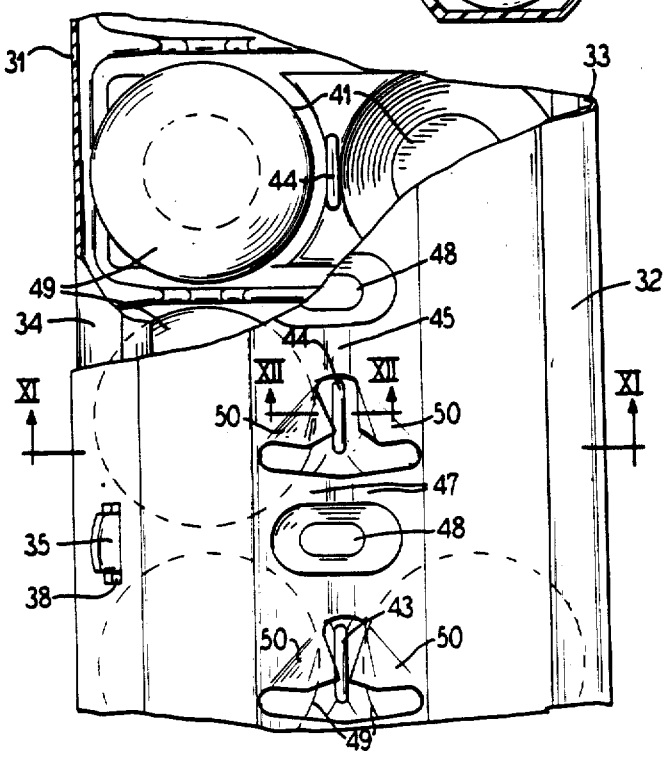
FIG. 12
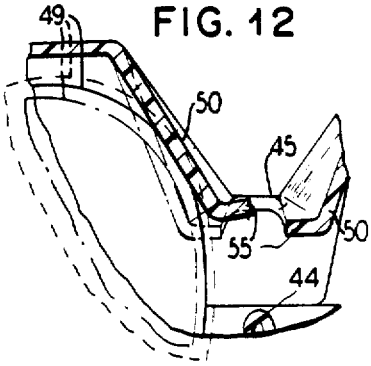

*Commissioner of Patents and Trademarks*